US008713871B2

(12) United States Patent
Wallin

(10) Patent No.: US 8,713,871 B2
(45) Date of Patent: May 6, 2014

(54) MODULAR WALL SYSTEM WITH FOOTING FORM

(76) Inventor: Arne B. Wallin, Elmvale (CA)

( * ) Notice: Subject to any disclaimer, the term of this patent is extended or adjusted under 35 U.S.C. 154(b) by 955 days.

(21) Appl. No.: 10/553,101

(22) PCT Filed: Apr. 19, 2004

(86) PCT No.: PCT/CA2004/000559

§ 371 (c)(1),
(2), (4) Date: Oct. 17, 2005

(87) PCT Pub. No.: WO2004/092487

PCT Pub. Date: Oct. 28, 2004

(65) Prior Publication Data

US 2008/0104909 A1 May 8, 2008

(30) Foreign Application Priority Data

Apr. 17, 2003 (CA) ..... 2425811

(51) Int. Cl.
*E04B 7/00* (2006.01)

(52) U.S. Cl.
USPC ..... 52/270; 52/274; 52/250; 52/293.1; 52/294

(58) Field of Classification Search
USPC ..... 52/274, 293.3, 292, 293.1, 294, 309.12, 52/309.17, 250, 259, 169.9, 169.8
See application file for complete search history.

(56) References Cited

U.S. PATENT DOCUMENTS 1,834,892 A * 12/1931 Betzler ..... 52/284
2,099,077 A * 11/1937 Pessagno et al. ..... 249/27
3,952,471 A * 4/1976 Mooney ..... 52/602
4,090,266 A 5/1978 Price
4,512,126 A * 4/1985 Walston ..... 52/251
4,830,543 A 5/1989 Joubert
5,111,628 A * 5/1992 Desjoyaux et al. ..... 52/169.7
5,367,845 A 11/1994 Hartling
5,511,761 A * 4/1996 Schultz ..... 249/34
5,588,272 A 12/1996 Haponski
5,588,786 A * 12/1996 House et al. ..... 405/285
5,785,459 A 7/1998 Swininer
5,864,999 A * 2/1999 Wallin ..... 52/293.1
5,922,236 A 7/1999 Zuhl
6,003,278 A 12/1999 Weaver et al.
6,244,005 B1 * 6/2001 Wallin ..... 52/293.1
6,256,960 B1 * 7/2001 Babcock et al. ..... 52/592.1
6,332,599 B1 * 12/2001 Spartz ..... 249/34
6,681,537 B2 * 1/2004 Queirel ..... 52/274
2002/0079424 A1 6/2002 Wells
2006/0277851 A1 12/2006 Hudon et al.

FOREIGN PATENT DOCUMENTS

FR 4406049 10/1977
FR 2717848 3/1994

* cited by examiner

*Primary Examiner* — Jessica Laux
(74) *Attorney, Agent, or Firm* — David J French

(57) ABSTRACT

A pre-cast panel has forms mounted thereon for forming post-like flanges and a footing. Upon erection of an array of panels, the flanges and footing may all be cast on-site, with appropriate reinforcing/coupling means present within the form core volumes, by filling such forms with binder material such as concrete. Optionally, an upper beam may also be formed in a similar manner, the pre-cast panel being provided with an upper beam form which is attached to the wall portion of the panel and interconnected to the previously described forms.

20 Claims, 8 Drawing Sheets

MODULAR WALL SYSTEM WITH FOOTING FORM

FIELD OF THE INVENTION

This invention relates to the construction industry. More particularly it addresses a modular wall system based upon pre-formed panels and accessory elements that may be erected on a site to provide a wall suitable for a building.

BACKGROUND TO THE INVENTION

Building technology has an ancient history. Amongst the most classical forms is "Beam and Post" construction. Construction techniques based upon the use of pre-cast panels for forming walls are also known. This includes panels which are tipped-up for positioning on a pre-installed foundation and then fastened together by various means.

In the case of pre-cast systems, wall panels have been employed incorporating pre-cast beams and posts, (serving as studs and as top and footer plates) already cast in place on wall portions, cf. U.S. Pat. No. 6,003,278. Being based upon fully pre-cast panels, exposed metal linkages are typically used to join adjacent panels along the top and bottom perimeters.

A number of prior art inventions that describe the use of pre-cast concrete wall panels are referred-to in U.S. Pat. Nos. 5,864,999 and 6,244,005 by this present inventor, the contents of which are adopted herein by reference. These latter references describe a pre-cast wall panel with inwardly extending, vertical flange portions that have reinforcing members protruding downward for coupling to a footing member, typically pre-cast. The footing member may be pre-cast or cast on-site.

The casting of footings on-site in conjunction with the simultaneous casting of vertical members is addressed in a number of prior art references. U.S. Pat. Nos. 5,367,845; 5,922,236 and 6,332,599 all contemplate the simultaneous filling of a wall form and a footing form to produce a continuous wall overlaying a footing. U.S. Pat. Nos. 4,82,33 and 5,785,459 as well as application US 2002/0079424 A-1 refer to the simultaneous formation of a post over a footing wherein the forms for an interconnected footing and post are left in place after the concrete grout has been poured and set.

In U.S. Pat. No. 4,090,266 vertical forms to serve as posts for a wall are filled simultaneously with a separately provided form that defines the volume of a footing. In U.S. Pat. No. 5,111,628 vertical forms fastened to a wall are connected to horizontal form means positioned along their upper ends. Both such form means are then filled simultaneously to provide posts to support the wall, together with a top beam or plate. Corresponding French patents to the same inventors are FR 4,406,049 and FR 2,717,848.

The above referenced U.S. Pat. No. 5,864,999 to the present inventor describes a system for installing a fully pre-fabricated wall with pre-cast flanges on a pre-cast footing. According to the design of U.S. Pat. No. 6,244,005, pre-cast concrete panels are fitted with hollow forms which allow beams and posts to be cast on-site over footings. In this second case, a cast-on-site concrete upper plate or beam is formed by pouring concrete into an upper trough that has been fitted with linked reinforcing rods. This provides a fully secured upper plate perimeter for the final wall structure. Conceptually, this is the reverse of classic beam and post construction wherein the walls are added as in-fill after the beams and posts are erected.

Many of the aforesaid inventions presuppose that a separate footing is to be employed upon which the wall panels are to be anchored. The present invention is premised on the formation of a footing portion at the job site, rather than by casting the footing separately, with the footing being formed at the same time as portions of the wall support system.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to one aspect of the invention, a wall panel carries not only hollow vertical forms for posts, but also a form for a footing. Fixed to pre-formed wall panels, such hollow forms, once the wall panels are erected in place, receive poured concrete grout to provide posts and footings. In particular, the wall panels have a sheet material, preferably of steel, fitted along the bottom edge of the wall panels to act as a footing form. Concrete or other appropriate binder is introduced into the footing form through the vertical forms.

The wall units may also have an upwardly open upper trough of sheet material, preferably steel, fitted along the top edge of the wall panels. The footing form is like the upper trough form, except that it is inverted ie, it provides a downwardly-directed, open, volume that is capped on its upper side by the steel of the footing form so as to be upwardly closed and serve to confine binder when filled with binder between the footing form and a supporting surface underneath. The footing form volume interconnects with the inner volume of the hollow vertical forms.

The invention in another aspect is thus directed to a modular wall system comprising a plurality of panels wherein each panel comprises: (a) a wall portion and one or more hollow flange forms each having a hollow interior and being mounted on such wall portion for casting one or more outwardly extending flanges on said wall portion; and (b) a hollow footing form for forming a footing, the interior of the hollow footing form communicating with the interior of the hollow flange form wherein:

i) the panels are dimensioned to be joined end to end and the footing forms may be interconnected to provide a continuous wall and footing of extended length, ii) the vertical flange form and footing form define interconnected volumes for containing binder material to be poured into the footing form through the vertical flange form to provide the wall portion with both a flange and a footing, and iii) the footing form of each panel extends along the base end of a panel for the width of the panel to provide a continuous, contained, footing volume that is interconnected with the interior flange volumes of vertical flange forms and, when assembled with adjacent panels, the footing volumes of adjacent footing forms, whereby the footing form can be filled with a continuous volume of binder material that serves as the footing along the base end of the panel.

At a job site, such wall panels are lowered onto a pre-prepared base and aligned to their final positions with the wall panel portions precisely aligned, edge to edge. When positioned in a trench, as in the case of a frost wall, the footing forms over-lies a prepared gravel base within the trench. The horizontal sheet metal portions of the lower footing form and upper trough, if present, overlap and are joined by screws or other fastening means. These upper and lower forms by being so joined are destined to provide continuous top beam and foundation castings.

Within the upper and lower forms reinforcing means, preferably steel bars and preferably linked together, are arranged to extend between panel sections. Optionally, but preferably, coupling means extend between the inner volumes of the flange and the respective trough and/or footing forms. The footing, beams and posts of a finished wall are now ready to be cast-in-place.

Optionally but preferentially, coupling means may be in the form of a reinforcing bar or heavy gauge wire, or even portions of the flange forms, which extend from the hollow flange forms into the interior volume of the footing forms. Such coupling means (protruding downwardly from the lower end of each of the hollow flange forms) are embedded in the binder within the footing form. Such coupling means are also preferably connected to reinforcing means present within the interior of the hollow footing form. When portions of the outer sheeting material forming the walls of the vertical flange forms extend into the binder in the footing form to serve as coupling means, the outer sheeting of such the forms then serves as reinforcement extending between the cast-in-place portions of concrete in the final wall system.

The concrete pouring stage is straightforward. A fluid concrete slurry poured into the upper trough, if present, is directed to flow downwardly through the vertical tubes that will form the posts. The concrete "grout", filler or binder poured into the upper exposed ends of the vertical forms, serves as a fill or binder. The concrete is mixed to a flowable consistency, optionally with additives such as super plasticizers to increase flowability. On reaching the bottom of such vertical tubes, the concrete fills-out the footing. Hydraulic pressure causes the concrete to flow, running along over the gravel bed. Concrete poured down through successive vertical tubes fills the footing volume. Concrete flow may be encouraged by vibrators preferably lowered into the concrete and/or applied to the outsides of the forms to remove air pockets and encourage flow. The steel of the footing form serves as a cap to contain the concrete in place until it sets to form the final footing.

Because the footing form is downwardly open, the poured concrete footing will be in intimate contact with and will conform to the base of compacted gravel. The concrete or binder within the footing and flanges is integrally connected, and the concrete or binder running along the base of the footing form is substantially continuous between panels, potentially endlessly.

Thus, the invention according to one aspect relies upon the presence of hollow forms coupled to a pre-formed wall panel for subsequent filling with a binder material such as concrete to produce both a vertical flange on the panel, once the open hollow interior of the form is filled with the binder material, and a footing. The flange on the wall panel may then function as a post to support a top-side horizontal beam which may optionally be cast of the same time.

According to a method for erecting a wall, a base is leveled to a true height, within a tolerance. The base may be a gravel bed or may also be the top of a previously installed wall. Several panels according to the invention are then placed in line along the base. Height irregularities may be adjusted by shims. To keep the panels in line, props may extend to the adjacent soil or suitable supports and the panels may be partially backfilled. More particularly wooden or metal props with or without metal brackets and fasteners may be temporarily attached to the metal forms to maintain alignment, and to safely and securely support the assembled walls. As a further alternative for maintaining alignment, straightening brackets such as lengths of lumber may be temporarily clamped near the top edge of the panels.

The outer vertical side edges of the panels may be equipped with half-formed sheet metal flange forms, as described in U.S. Pat. No. 6,244,005. Portions of the half-form sheeting may be bent-out to form tabs which extend to adjacent half-forms so that such half-forms may be fastened together with sheet metal screws or similar fasteners, extending through the overlapping portions of the sheet metal forms. Preferably, nailer strips are applied to the inner vertical edges of the flange forms before they are filled with binder.

A panel may have a single flange form or two or more hollow full or half flange forms for casting multiple flanged portions, as described in U.S. Pat. No. 6,244,005. Preferably, the material for the flange and footing forms are of sheet material, e.g. galvanized steel or plastic which is fastened along one edge of the sheet material, as by embedment or through fasteners, to the pre-formed wall portion. Embedded edges of the form sheeting may be interrupted into tabs that are splayed or twisted out of alignment to reduce the tendance for cracks to run together. Additionally, some tabs may be bent at 90 degrees to serve as depth gauges for insertion of the edges into the unset concrete of the wall portion during the manufacturing process.

The forms themselves serve as reinforcing for the binder they eventually contain. To improve coupling between these forms and the binder with which such forms are eventually to be filled, without precipitating fracturing of the sheeting material, portions of the walls of the forms may be depressed or deformed inwardly to provide dimples or tabs to be embedded within the binder when the binder is poured into the forms. This improves the composite effect of the forms in serving as a reinforcement to the concrete.

The sheeting material of the footing form is seated with its wall-mounted edge extending along the side of the wall portion near the bottom end of each panel. The sheeting material of the footing form may then extend outwardly away from the wall and, eventually, downwardly to define the enclosed footing volume, for overlying a supporting foundation base. The footing cross-section so formed may be rectangular, trapezoidal or even triangular. Thus this sheeting material may proceed directly downward from the wall panel to its terminal edge or may form a bend between these two limits.

To ensure firm engagement of the outer edge of the sheeting material with the base, such material may be resiliently elastic, with the lower edge of the outer boundary of the sheeting material for the footing form extending below the lower edge of the wall portion in its relaxed state before the panel is placed upon the base. When placed on a horizontal, flat base such lower edge will then be deflected upwardly into general alignment with the lower edge of the wall, while bearing resiliently, with a downward pressure, against the base. Spikes or the like may optionally be used to further anchor the outer end of the footing form to the base during the concrete pouring procedure. For this purpose, small holes may be formed in the sheeting material of the footing form, along its outer edge.

This outer edge is preferably bent inwardly and preferably then bent again, a second time, towards being doubled-back to provide a hooked inner edge for intimate engagement with the concrete of the footing, once cast.

When the panels of the invention are provided with a form mounted along its upper edge to serve as an upper trough the upwardly extending sidewalls of adjacent trough forms are preferably jointed. This provides alignment so that a continuous, cast-in-place, upper beam may be created spanning the tops of the pre-cast panels. When continuous reinforcing bar or other reinforcing means is laid in this trough, before it is filled with concrete extending for the length of encircling walls, as for a basement foundation wall or frost wall, such walls are effectively "belted" or tied in place.

Further, other coupling means, such as bolts may be embedded into the upper trough binder material at the time of casting for subsequent coupling to other building attachments. One such attachment may be a further pre-cast wall panel mounted above the first wall. Such coupling means may also engage or attached to the previously mentioned reinforcing means.

Additionally or alternately, reinforcing/coupling means may extend from the pre-cast wall portion into some or all of the form volumes. This may be in the form of reinforcing bar or looped heavy gauge wire embedded in the wall portion and extending horizontally or at an angle into such volumes, preferably for connection to reinforcing means present therein. Such reinforcing bar or loops along the upper edges of the wall panels may also serve as lifting loops during manufacture and installation of the wall panels.

Vertical corners for an outside corner may also be created through provision of a pre-cast corner piece shaped to receive the abutting vertical edges of adjacent wall panels. Sheet metal positioning plates with a horizontal surface bounded by upwardly bent flanges may be positioned beneath and optionally on top of the corner piece and immediately adjacent the walls of the abutting panels, embracing both the corner bottom ends of the two walls. The two half-flange forms of the adjacent wall panels may then be joined by a joiner piece such as an angled strip, by sheet-metal screws or other appropriate fastening means. This provides a vertical cavity that communicates with the upper trough volume and can be filled with concrete grout. This vertical cavity may also communicate with the footing volume.

Similar, small "U"-shaped sheet metal plates may be placed beneath and above the bottom and top edges of adjoining wall panels where they meet. These plates provide alignment for the wall panels and assist in shimming the panels, if necessary, by providing a firm base surface for shims.

To support a structural beam that spans the interior of the structure, pre-cast wall panels may be fitted with additional vertical post forms similar to a flange form. This can be planned in advance at the casting site. Such additional vertical post forms may be installed at the precise position where a beam is to meet the wall panel. The sheeting defining such forms may be notched at its upper end to form a beam-pocket that will receive the end of the beam. A portion of such notched sheeting forms an upwardly open volume adjacent said wall panel for receiving binder material. Such upwardly open volume may then meet with the lower surface of the upper trough which is cut open to permit the beam post volume to be filled with concrete grout from the trough. Similarly, the bottom of the beam post form may communicate with the footing volume to allow for continuous concrete to extend between both members.

To provide wall portions which are exterior to the building, optionally vertically stepped, the exterior wall panels are positioned edge-on against the outside of the exterior wall surface. The half-flange form of the exterior panel is positioned to abut a portion of the wall of the other panel at a location opposite a flange form. Before concrete is poured, the face surface of the wall adjacent this flange form is drilled to permit a connecting rod of reinforcing bar or the like to extend from, one flange form volume into the flange form volume of the adjacent, abutting wall. To insert threaded rod or a bolt from the inner side of the flange form, the inner end of the flange form itself may be drilled to provide an access opening. The other end of such a bolt may then pass through a hole drilled in the half-flange form of the abutting wall panel. Such connecting members will then hold the two walls in position until concrete binder is poured, and thereafter serve as, reinforcing coupling means.

While the wall panel has often been described as being formed of pre-cast concrete, it may be formed of any other suitable material.

The system of the invention provides a number of advantages. Linked reinforcing rods may extend through all of the volume of the cast-in-place concrete. The integrity of the system is optimal.

Further advantages of this new concept include the minimal preparation of the base at the job site. No separate footing forms need be installed. Nor are there any forms to remove. The tubular sleeves that serve as forms also serve as reinforcement for the concrete, once poured.

The pre-cast panel portions ensure that perfect alignment and positioning can be achieved. The pre-cast wall panels, which may be readily aligned in place, serve as a "jig" for accurately positioning of the post and beam forms.

While described in a foundation-mounted basement or frost wall application, the wall system of the invention is equally applicable to the construction of full-height walls above ground. Walls of the invention are suited for use as load bearing walls both below and above grade, and in residential or commercial construction.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 3:
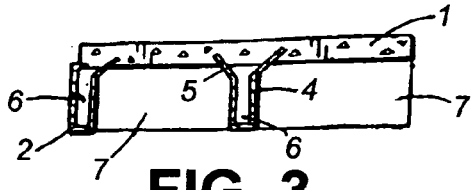
FIG. 3 is an upwardly directed, cross-sectional end view of the panel of FIG. 1.
Figure 4:
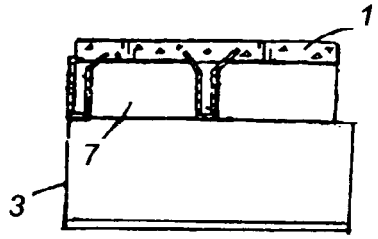
FIG. 4 is a downwardly directed, cross-sectional end view of the panel of FIG. 1.
Figure 1:
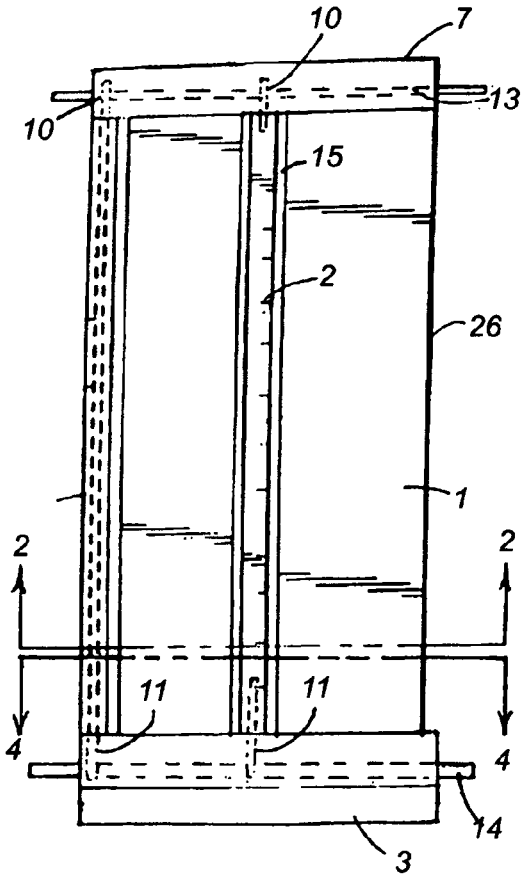
FIG. 1 is a face view of the side of one variant of the invention in the form of a wall with a top beam trough, vertical flange forms and a footing form.
Figure 2:
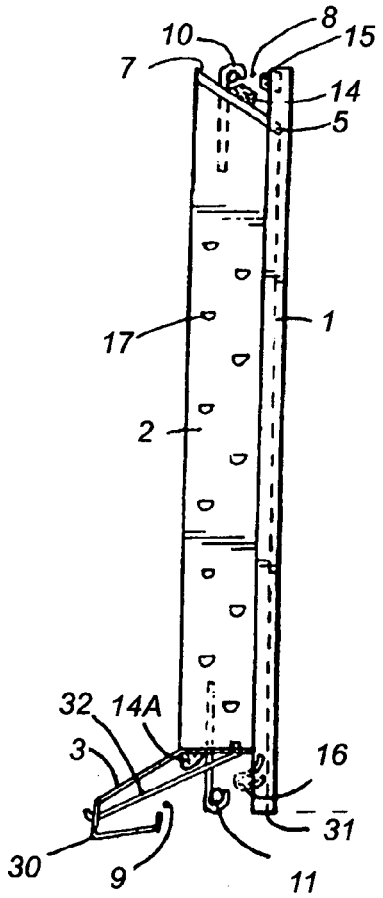
FIG. 2 is a side edge view of the panel of FIG. 1.

FIGS. 1, 2 and 3 show a prior art panel 1 as depicted in U.S. Pat. No. 6,244,005 with two hollow flange forms 2 modified by the addition of a footing form 3 to provide the present invention. The flange forms 2 are of a sheet material, such as galvanized sheet steel. The flange forms 2 are bent to a "U"-shaped cross-section with the edges 5 of the legs 4 of the "U" embedded into the panel 1 at the time of casting the panel 1. Each flange form 2 has a hollow core 6 which serves as a flange form volume 6.

A lower footing form 3 is cast in-place along the lower portion of the panel 1 adjacent to the base end of the wall panel 1 and extending across the width of the wall panel 1 to the respective vertical side edges 26 of the wall panel 1. The form 3 is:

i) attached to and extending laterally away from the wall, portion on the flange side of the wall panel 1 so as to remain with the wall portion in such orientation once the footing volume 9 has been filled with binder material, ii) positioned beneath and extending laterally from the flange form 2 to provide a footing volume 6 whereby the footing form 3 can be filled with binder material that serves as a footing along the base end of the panel 1, iii) upwardly closed for covering and confining such binder material between the footing form 3 the flange side of the wall portion 1 and the supporting surface, when the wall panel is installed on such supporting surface, iv) open at the ends of the footing form 3 that are adjacent to the respective vertical side edges 26 of the wall panel 1.

The interior of the footing form 3 is open in the downwardly directed direction. The inner volume 9 of the footing form 3 communicates with the flange form volume(s) 6 to provide continuous, enclosed volumes 9 that serve to contain binder material poured into the footing form 3 through the vertical flange form. When two such preformed wall panels 1 are positioned next to each other along their vertical side edges 26, the adjacent openings at the ends of the enclosing footing form 3 will permit a continuous, interconnected, covered, footing volume 9 to extend between two adjacent wall panels 1 whereby the footing forms 3 can be filled with a continuous volume of binder material that serves as the footing for the building wall.

An upper trough form 7 is also preferably cast in place on the panel 1, spanning between the flange forms 2 to permit casting of an upper beam. The interiors 6 of the flange forms 2 communicate with the volume 8 of the trough formed by the upper trough form 7. This upper trough form volume 8 is interconnected with the flange form volume 6 to permit the form volumes 6,8, 9 to be filled simultaneously with a continuous quantity of binder material, with the upper trough 7 providing a"funnel"action during the on-site casting of a binder material. This is achieved because, as will be seen from FIGS. 1, 4, 5 and 8 the vertical flange forms 2 and footing form 3 define interconnected volumes 6, 9 for containing binder material to be poured into the footing form 3 through the vertical flange form 2 to provide the wall portion with both a flange and a footing. The footing form 3 of each panel 1 extends along the base end of a panel 1 for the width of the panel 1 to provide a contained continuous footing volume 9 that is interconnected with the footing volume 9 of adjacent forms 3 whereby the footing form 3 can be filled with a continuous volume of binder material that serves as the footing along the base end of the panel 1 and the wall formed by such panels.

On assembly as a wall panel, coupling bars 10,11 which serve as upper and lower coupling means may be inserted into the interior volumes of the flange form cores 6, protruding to respectively lie within the upper trough volume 8 and to extend downwardly below the panel into the footing form volume 9. Upper beam horizontal reinforcing bars 13 and footing reinforcing bars 14 may be placed in their respective forms 7,3 and optionally tied to the reinforcing coupling bars 10,11 by reinforcing couplings 34 seated in and protruding from said wall portion 1 into any one or more of said flange or footing volumes 6, 9 to position and support reinforcing rod placed within said one or more volumes.

Preferably such horizontal bars 13,14 are interconnected respectively along the lengths of the trough and footing form volumes 7,9.

In lieu of coupling bars 10,11 inserted into such interiors 8,9, a portion 14 of the flange form 2 itself may protrude into the trough volume 8 for engagement with the upper beam. Alternately, an anchoring plate may be bolted to the form 2 to protrude in a similar manner. Similarly, a portion 14A of the flange form 2 may extend into the footing volume 9 to provide coupling.

Connecting rod means seated in the flange form volume 6 and/or trough volume 7 can also extend upwardly to serve as coupling means for other building components, such as for the vertical stacking of courses or tiers of wall panels. The coupling rod 10 in the flange form volume 6 may but need not extend all the way between the respective upper beam and footing form volumes 6,9. It is sufficient, when employed, for rod 10 in the flange form 2 to extend only partially into the flange form volume 6, sufficient to be fixed in the concrete binder.

Figures 9, 10:
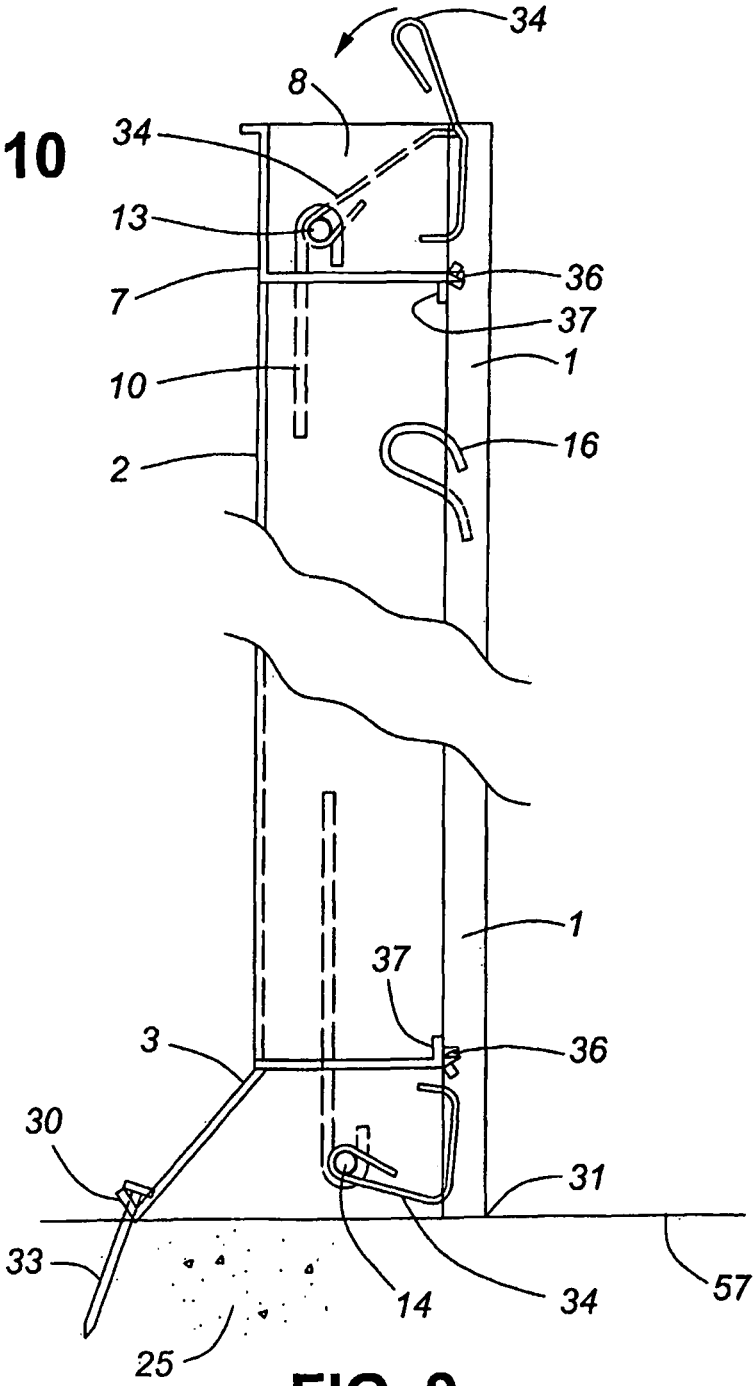
FIG. 9 is a detailed cross-sectional end view of the lower portion of one variant of the footing trough positioned over a base.
FIG. 10 is a cross-sectional end view of the upper trough and wall panel portion showing reinforcing bar.

To couple the wall panel 1 more securely to the upper beam to be formed in the trough 7, protruding reinforcing 15 may be embedded in the wall 1 next to the trough volume 8. Shown as a tab 15 in FIG. 3, this reinforcing/coupling may comprise lengths of 6 or 7 gauge galvanized iron wire, as shown in FIG. 10. Similar reinforcing 16 may extend into the footing and flange form volumes 9,6.

The walls of the forms 2,3,7 may have bent tabs 17 punched inwardly into the flange core 8. These tabs 17 become embedded in the cement or binder material to be used as filler when the flange cores 6, upper trough volume 8 and footing volume 9 are filled. This increases the coupling between the forms 2,3,7 and the binding filler, increasing their composite strength.

By providing an upper plate of the sufficient width, bricks may be laid directly on top of the wall in its final, installed form. A brick ledge may also be pre-cast into a wall panel, providing the wall panel with a zigzag cross-section. The sheet-metal flange forms 2 are correspondingly reshaped to conform to this zigzag.

A brick ledge in the form of a horizontal angle iron may be provided by casting a protruding bolt in place on the wall panel 1 whereby the angle iron may be installed subsequently. Alternately, the bolt may be installed after the wall panel has been cast by drilling holes in the wall panel at the location of a flange form 2. A hole may also be drilled in the vertical edge of the flange form 2 to receive the bolt or a threaded rod that is to extend through the wall panel before the flange form 2 is filled with grout.

Figure 5:
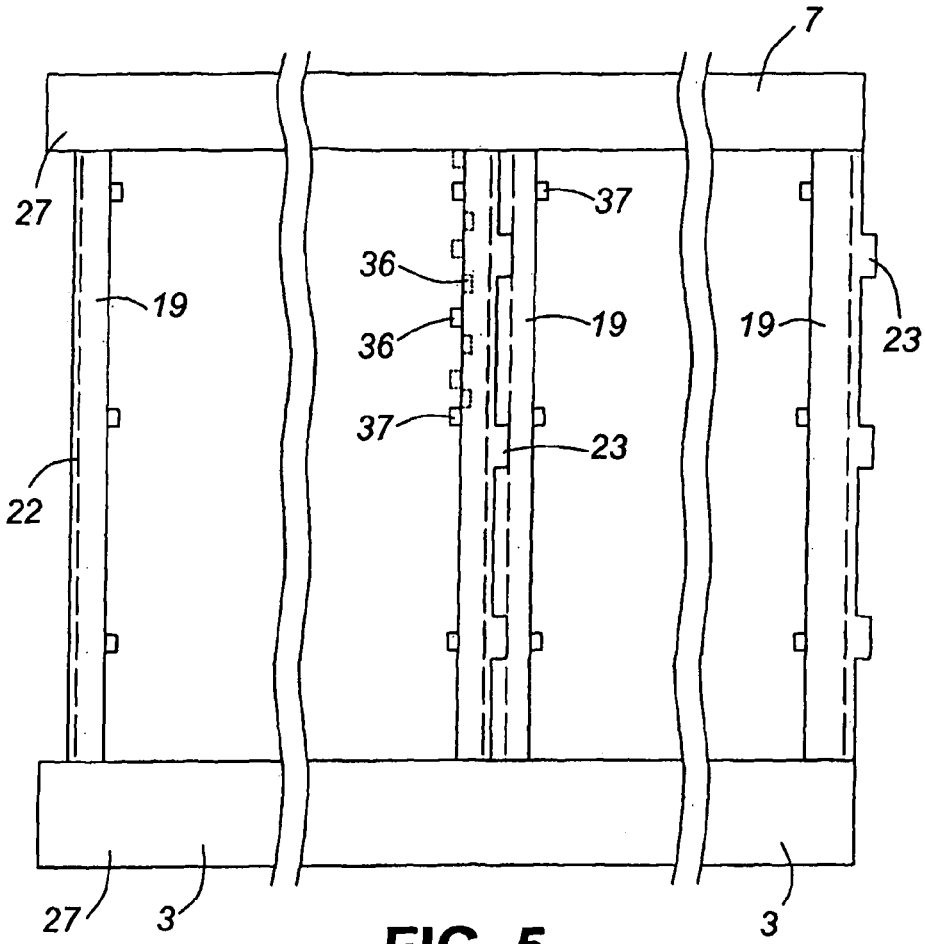
FIG. 5 is a side face view of a wall panel according to the present invention with flange and footing forms present and including a preferred but optional top beam form.
Figure 7:
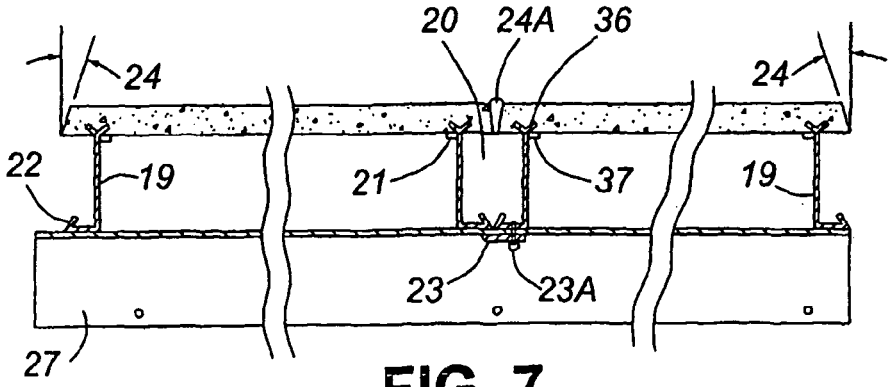
FIG. 7 is a top, cross-sectional, downwardly-directed view through the wall panel of FIG. 5.
Figure 6:
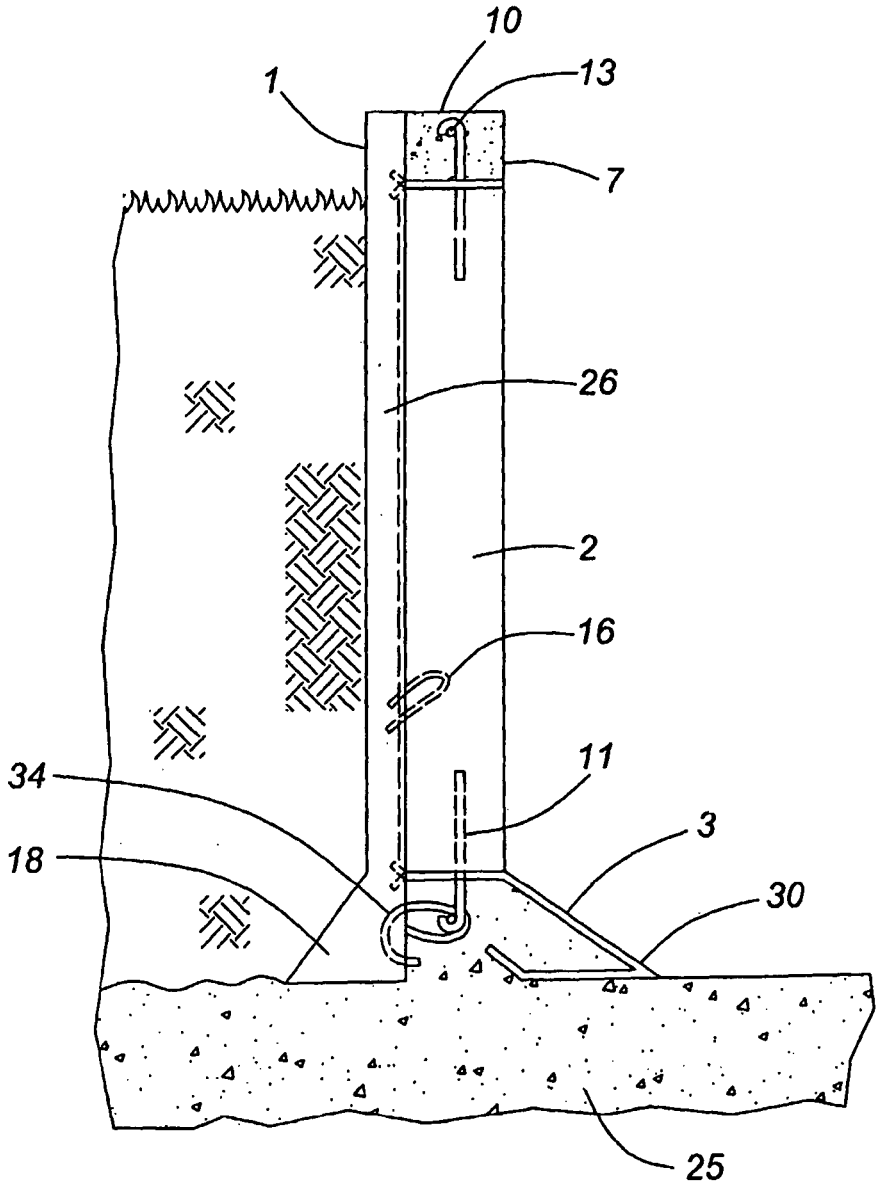
FIG. 6 is a vertical edge view of the panel of FIG. 5 installed on a base at a site.

FIGS. 5, 6 and 7 show an alternate prefabricated wall panel 1 in accordance with the invention wherein the wall panel 1 has outer flange forms 19 which are in half-form format as described in U.S. Pat. No. 6,244,005. FIGS. 5 and 7 have been broken to show only the half-flange forms 19. Multiple full flange forms would be present between these half-forms 19.

When the panels 1 are abutted, a closed volume 20 is created between the half-forms 19 as shown in FIG. 7. The half-forms 19 have panel-embedded edges 21 as in the other embodiments. The opposite longitudinal edge of the half-forms 19 has an inwardly-bent, free-end flange 22. The free-end flanges 22 of abutting forms 19 will become embedded in the filler to be placed in the interior volume 20 of the combined forms 19.

Portions of at least one of the half-form edges may be bent-out to form tabs 23 as shown in FIG. 7. These tabs 23 extend to adjacent half-forms 19 so that such half-forms 19 may be fastened together with sheet metal screws 23 or similar fasteners, extending through the overlapping portions of the sheet metal forms.

By providing half-forms 19 at the edges of each panel 1, the filler serves to seal and stabilize the joint between the two panels.

The sheet-metal mold form used to cast the wall panels may have a "release angle" 24, e.g. 2 ½ degrees, on the form edges—see FIG. 7. Abutting wall panel edges then combine to provide a wedge-access e.g., 5% for injection of glue/grout 24A from the outside To bond the concrete of a flange to the wall panels 1 more securely at panel joints, the face surface of each of the panels 1 adjacent their vertical edges 26 can be cast with a coupling groove extending the height of the panel 1. This groove, perhaps a quarter of an inch deep and three quarter inches wide, optionally dovetailed, will receive grout poured into the flange form 2, more securely locking it in place.

Figure 8:
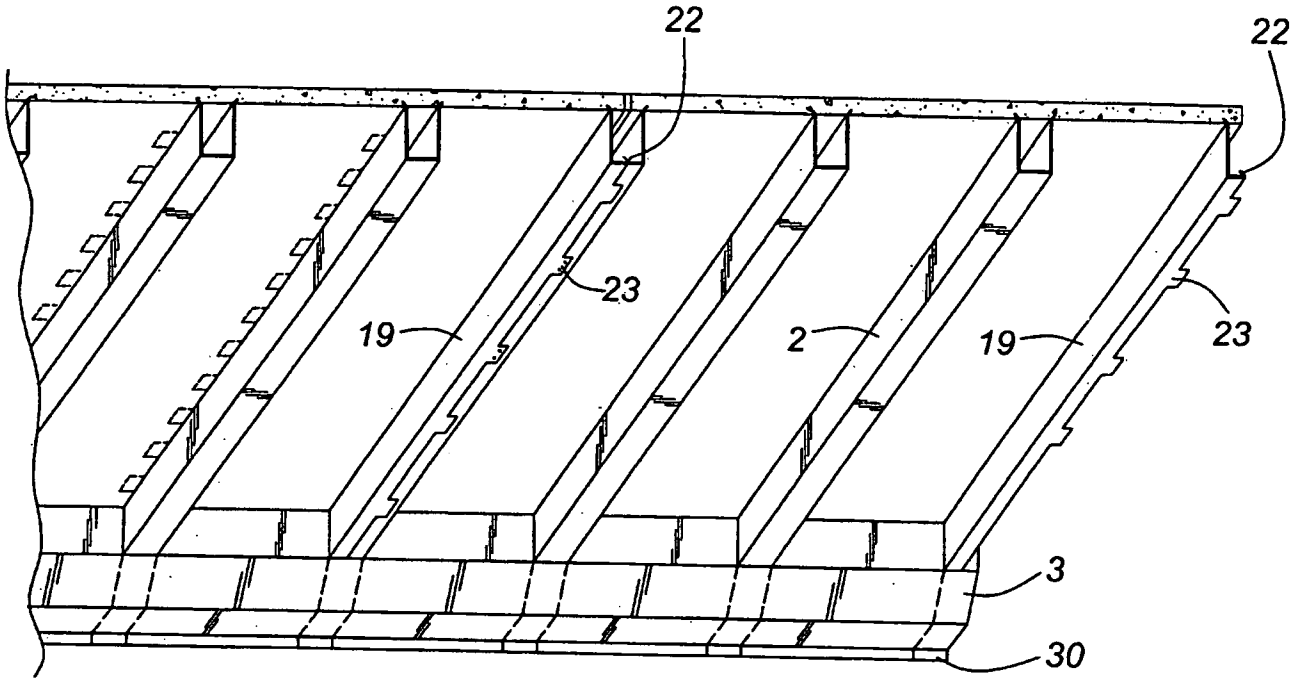
FIG. 8 is a pictorial view of a wall structure formed of multiple panels as in FIG. 5 but omitting the upper trough.

At the job site wall as in FIG. 6 panels 1 are assembled on a base 25 with the vertical edges 26 of the wall portions 1 abutting to produce a continuous wall structure as shown in FIG. 8. Portions of the footing forms 3 as shown in FIG. 7 extend beyond the half-flange forms 19 on at least one side as extensions 27 for interconnection of such forms 3 as by riveting of overlapping edges or through use of other fastener means. Thus the interconnected footing forms 3 provide aligned, continuously interconnected footing form volumes 9.

The base 25 is preferably of compacted aggregate or such other material as is required to provide a stable support surface 57 for the footing that is to be cast within the footing form 3. If the wall portions 1 are aligned and true, the footing form 3 will be aligned and true. If the base 25 is slightly off grade, the wall portions 1 can be shimmed into alignment.

As illustrated in FIGS. 2, 6 and 9, the footing form 3 has an outer bent edge 30 which is directed downwardly to bear against the supporting surface 57 of the base 25 on which the wall panels 1 are positioned. The sheeting material of the footing form 3 is preferably made of an elastically resilient material. The outer edge 30 is preferably constructed, to underlie the bottom edge 31 of the wall portion 1 when the wall panel is freely suspended, as shown in FIG. 2. By this means the outer edge 30 may be caused to bear with a resilient force against the support surface 57 of the base 25 when installed in position, reducing the tendency for the edge 30 to lift when the footing form volume 9 is being filled with binder material.

To hold the outer perimeter of the footing form in place, a tether cord or anchoring wire 32 may extend from the sheet-metal root of the footing form to its outer edge. This is to ensure that concrete does not push-out the footing form 3 during the pouring of concrete into the form. This feature is not required if a floor slab has been previously poured. Holes may be punched in the footing form sheet steel to receive a wire 32 hooked at both ends, to anchor this tethering element. At the same time, the wire 32 can be dimensioned to either slide or deflect when the wall panel 1 and footing form 3 are first installed, allowing for the spring-loaded displacement of the outer edge 2 of the footing form 3 when it is seated on its bed.

To further secure edge 30 fasteners 33 such as spikes 33 may be attached through edge 30 into base 25.

The wall panel 1 may be provided with cast-in-place wire loops 34 along its bottom, FIG. 9, and top, FIG. 10, portions. Protruding from the wall portion 1, loops 34 of number 6 or 7 gauge steel wire may serve both as lifting loops and, when bent down, as coupling means 8 between the wall portion 1 and grout that will fill the respective forms 2,3,7. Such wire 34 may optionally be coupled to reinforcing rod 13,14 present in the top beam and footing form volumes 8,9. A further end 35 of such wire 34 may protrude from the wall panel 1 into the trough volume 8 to serve as a guide when the wire 34 is being cast in place and to couple the top beam to the walls 1.

In embedding sheet material edges in concrete it is preferable to interrupt the straight run of the edge with indentation and/or deflection to avoid formation of a path which will serve as a focus for the creation of cracks in the concrete. Thus the form edges as shown in FIGS. 7, 9 and 10 are interrupted by bent tabs 36. These tabs 36 are splayed or twisted out of alignment to reduce the tendance for cracks to run together. Additionally, some tabs 37 may be bent at 90 degrees to serve as depth gauges for insertion of the edges into the unset concrete of the wall portion.

Vertical outside corners can be effected by joining two half-flange forms 19 after a first wall panel 1 has been positioned so as to abuts the next panel's vertical edge 26. In this configuration, the half-flange forms 19 will interfere with each other. One half-flange form 19 is removed or bent-back. The remaining half-flange 19 is fastened to the adjacent wall panel, or to the bent half-flange form 19 on the adjacent wall panel to provide a half-flange form corner volume. The upper trough and footing form sheeting, is cut to allow interfitting at these junctions.

To more securely anchor grout poured into this half-flange form corner volume, a vertical coupling groove can extend the height of the wall panel 1 on its inner wall surface, adjacent the inner corner edge and within the flange form volume. To even more securely couple grouting to the wall surface of the panel, a zigzag wire can be placed in the coupling groove before grout is cast in place.

Figure 11:
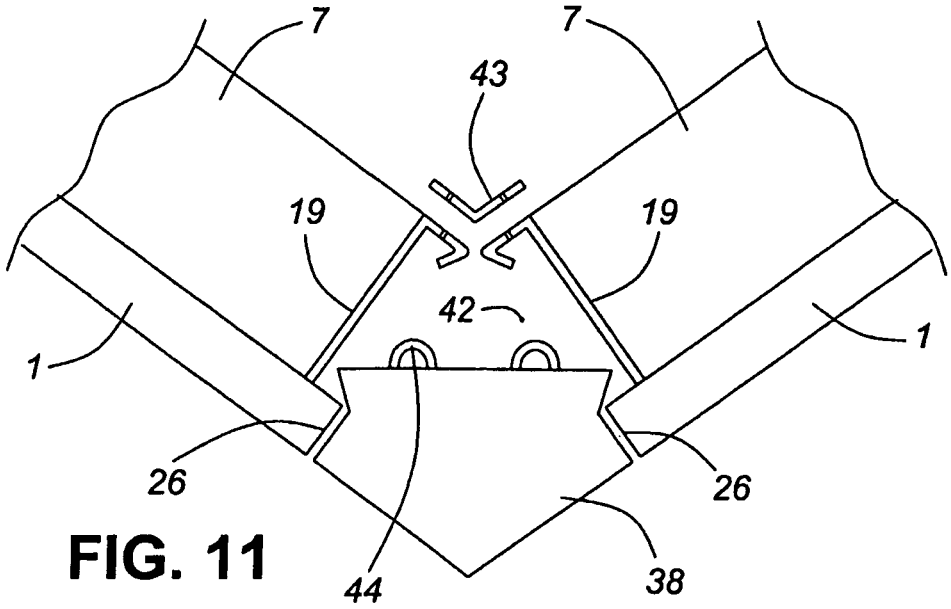
FIG. 11 is a plan view of a corner piece with two abutting wall panels in pale.
Figure 12:
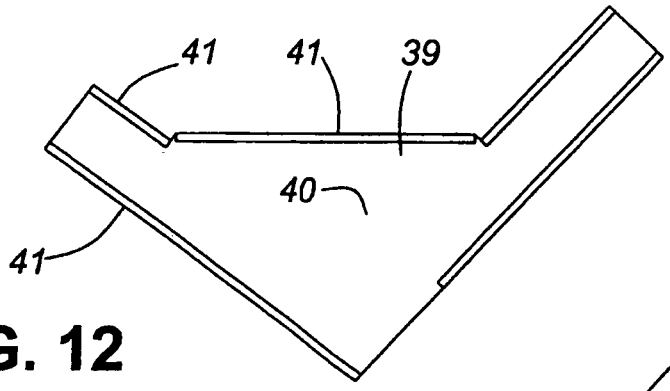
FIG. 12 is a plan view of a positioning plate for aligning the corner piece and adjacent walls.
Figure 13:
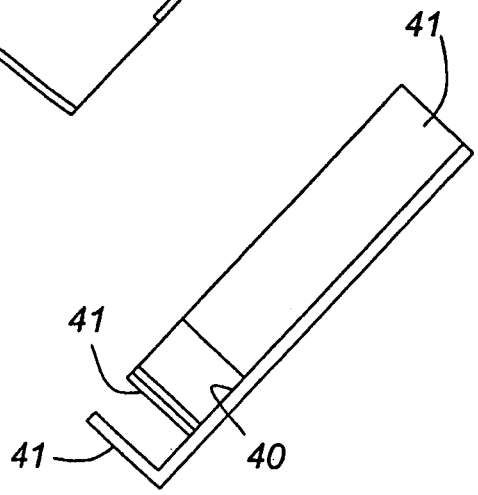
FIG. 13 is an edge view of the plate of FIG. 12.

An alternate treatment for an outside, vertical corner can be based on provision of a pre-cast corner piece 38 as shown in FIG. 11. This corner piece 38 is shaped to receive the abutting vertical edges 26 of adjacent wall panels 1. Sheet metal positioning plates 39, FIG. 12, with a horizontal surface 40 defined and bounded by upwardly bent flanges 41 may be positioned beneath and on top of the corner piece. The flanges extend to and embrace the immediately adjacent walls 1 of the abutting panels. With these positioning plates 39 installed, the corner piece 38 is held precisely in the correct position with respect to the adjacent wall panels 1.

The two half-flange forms 19 of the adjacent wall panels may then be joined by an angled strip 43, as by sheet-metal screws or other fastening means, to provide a vertical cavity 42 that communicates with the upper trough and footing volumes 8,9. By filling this vertical cavity 42 with concrete grout, the corner piece 38 is cast precisely in-place. Coupling means in the form of steel loops 44 or equivalent may be pre-cast into the inner surface of the corner piece 38 to become embedded in the concrete grout placed in the vertical cavity 42 and provide further anchoring for the corner piece 38.

Vertical corners for an inside corner may be formed by joining the separated ends of the respective half-form flanges 19 of abutting, angled wall panels with a sheeting. This sheeting defines an inside corner vertical cavity that may be filled with concrete binder.

When a basement floor is to be cast on one side of the wall, this surface may be poured first to meet with and overlie the outer edge 30 of the footing form 3 and thereby stabilize it in place. While this is optional, it is preferred to pour the floor slab before filling the wall forms, but with the wall forms in place. Rebar may then extend from the floor slab through a hole in the footing form 3, thereby anchoring the footing form 3 to the floor once the footing form 3 is filled. Conveniently, this rebar provides security for stabilizing the footing form 3 and the wall panel 1 once the floor slab has been poured but before the wall forms are filled. At this stage the wall panels can still be adjusted by shimming them vertically and by re-aligning them in the event that they have slipped out of alignment.

Figure 14:
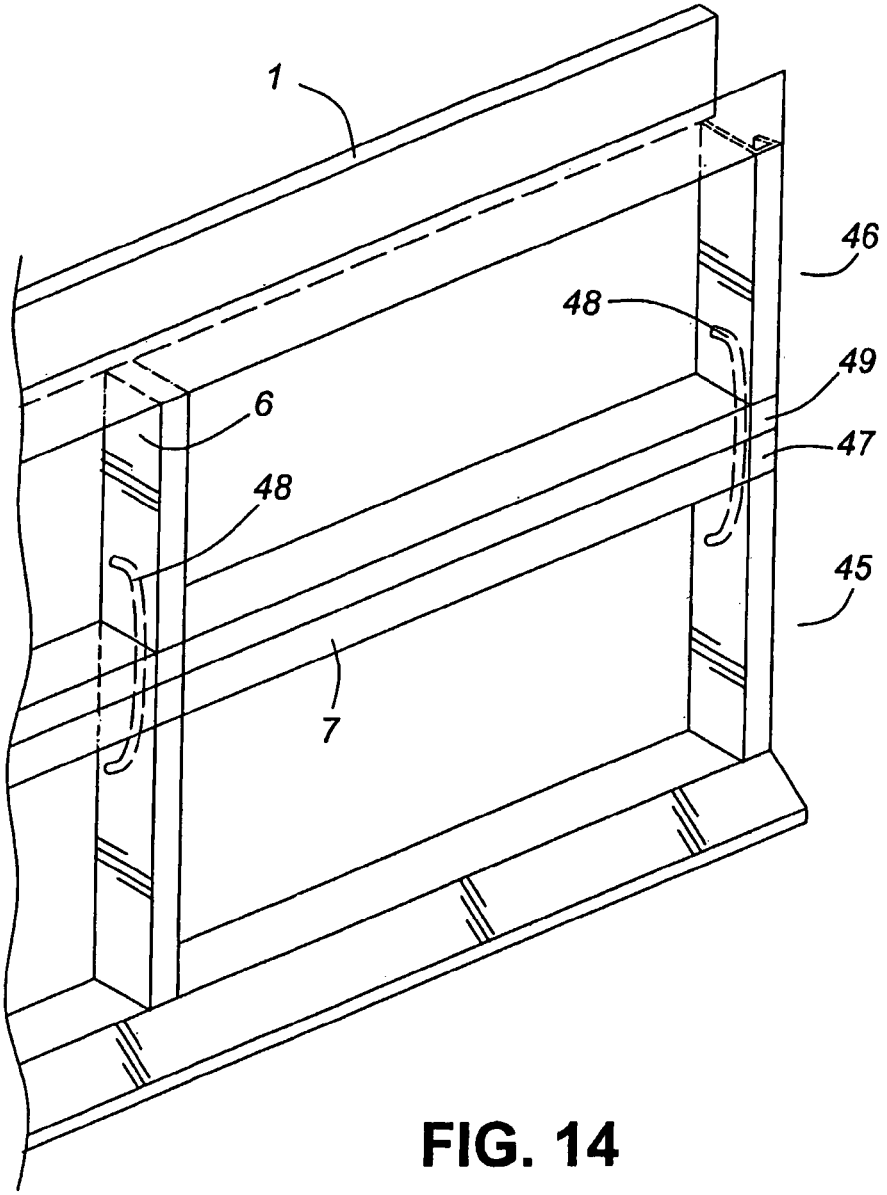
FIG. 14 is a view of two tiers of wall panels according to the invention, mounted one above the other.
Figure 15:
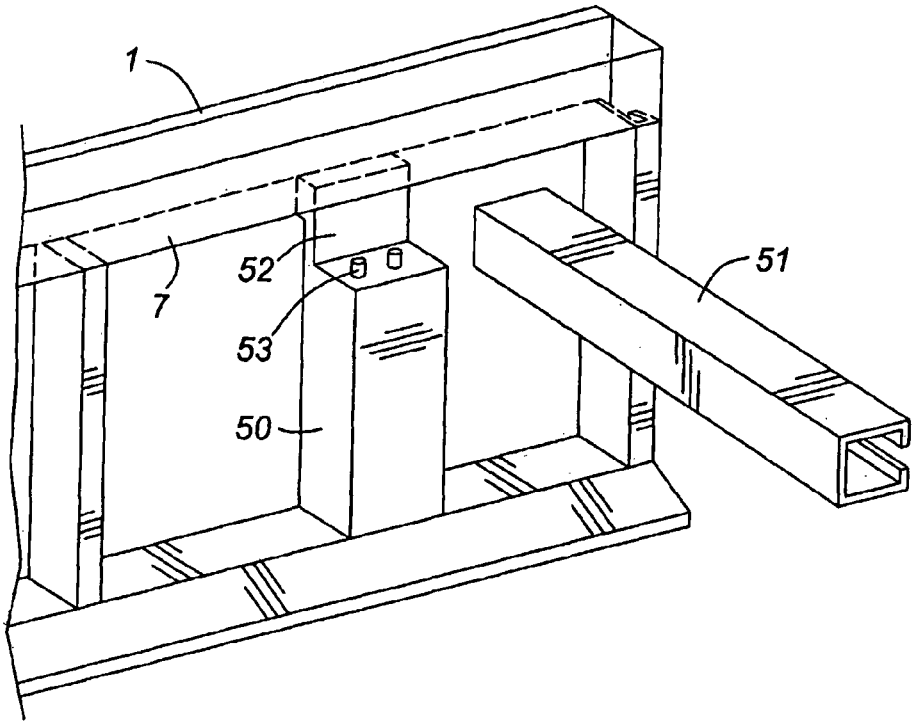
FIG. 15 is a pictorial of a beam post form with beam pocket fastened to a wall panel having an upper trough form.

While suited for foundations, walls according to the invention may be constructed in tiers. In this application a first tier wall section 45 is first cast in place. A second tier series 46 of wall panels is then positioned over the first tier, positioned to treat the upper beam 47 of the first tier 45 as a base surface for the second tier 46. This is shown in FIG. 14 herein.

In this application the panels of the lower tier 45 may have full footing forms 3. The next course up 46 omits the outer ledge 18 and need not have footing forms 3 but may simply sit on the upper beam 47 of the lower course 45. In casting the first tier 45, connecting means 48 are left protruding from the upper trough 7 to interfit into the vertical flange form volumes 6 of the next tier 46. To better seal and close the horizontal seam between courses, a fillet of cement may be mortered in place along the top beam 47 of the lower tier 45, covering the horizontal seam between wall panels. Alternately, an epoxy glue may be applied between the wall panels 1. Both the concrete surface of the upper beam 47, and the bottom edge of the upper panel of the two-course wall may be provided with coupling grooves to anchor the mortered fillet in place. The upper plate 47 of the lower course can have a zigzag wire cast along its edge, adjacent to the lower wall panel 1, to provide further anchoring and coupling for the mortered fillet.

Rather than trowel-on a hand-mortered fillet, a special second-course, upper panel can be prepared that has a "mini-" footing form 49 fastened to the wall panel dimensioned to over-lie the trough 7 of the first tier 45. In such case, horizontal reinforcing bar in the second tier footing volume can be connected to the connecting means 48 extending from the upper trough 7 of the first tier 45 panels.

Once a wall is erected, window openings may be cut using concrete cutting saws in the panel portions of the wall. Due to the relative thinness, e.g. 2 inches, of the wall portion 1 this cutting operation is relatively simple.

Alternately, special wall panels 1 may be cast with window openings already present therein. Sheet metal forming may then define an under-window trough which communicates with the interior cavity 6 of the two, adjacent, vertical flange forms 2. Concrete poured into the vertical flange forms 2 will then fill-out this window trough. To prevent overflow during pouring, this sill trough may be capped by a temporary cover, such as a sheet of plywood. The result is a pre-cast opening present in the wall panel 1, with a lower, cast-on-site sill which is ready to receive an on-site installed, window frame.

To support a structural beam that spans the interior of the structure, pre-cast wall panels 1 may be fitted with additional vertical post forms 50 similar to a flange form 2 of standard or increased width. According to specifications stipulated in advance by a customer, such additional vertical post forms 50 may be installed at the precise position where a beam 51 is to meet the wall panel 1. The sheeting defining such forms may be notched at its upper end to form a beam-pocket 52 that will receive the end of the beam 51. A portion of such notched sheeting may then meet with the lower surface of the upper trough form 7 which is then cut open to permit the beam post volume to be filled with concrete grout. The horizontal surface of this beam-pocket 52 may be fitted with protruding bolts or lengths of steel bar 53 before concrete grout is pouted into the vertical form, thereby providing an anchoring means for stabilizing the connection of the beam 51 and the beam-post.

To provide wall portions which are exterior to the building, optionally vertically stepped, the exterior wall panels 1 are positioned edge-on against the outside of the exterior wall surface. The half-flange form 19 of the exterior panel 1 is positioned to abut a portion of the wall 1 of the other panel at a location opposite a flange form 2. Before concrete is poured, the face surface of the wall adjacent this flange form 2 is drilled to permit a connecting rod of reinforcing bar or the like to extend from one flange form volume 6 into the flange form volume 20 of the adjacent, abutting wall panel 1. To insert a threaded rod from the side of the flange form 2, the inner end of the flange form itself may be drilled to provide an access opening. The other end of such a rod may then pass through a hole drilled in the half-flange form 19 of the other wall panel 1. Such connecting members will then hold the two walls in position while concrete binder is being poured, and thereafter serve as reinforcing coupling means.

While described as a method for coupling the edge 26 of a wall panel 1 to a wall surface, the above procedure may be similarly adapted to coupling upper troughs or footings, when these elements are vertically aligned.

As binder material, a concrete extended with expanded polymeric beads or gas bubbles, as for example generated by the addition of powdered aluminum or otherwise, may be employed. Such lighter weight concrete may also be employed for the panels. This reduces the weight of the wall panels 1, adds insulation value and provides flanges that are more readily nailable. When the spaces between flanges is to be filled with insulation, the presence of such beads in the flanges reduces the capacity of such flanges to serve as thermal conductors and induce condensation. Any tendency for such beads to weaken the concrete binder can be counteracted by addition of reinforcing fiber to the concrete or by increasing the wall thickness. Chopped nylon fiber is a preferred reinforcing.

By casting both the flanges which serve as posts and the footing on site in one operation, costs are reduced. Because key parts are pre-cast and incorporate pre-affixed forms, no forms need be created on-site. Further, by being fastened to pre-cast panels, the forms are precisely placed in the exact locations where flanges and the footing should be eventually installed. This greatly facilitates the erection process.

Although suited for basement and above ground walls, the invention is particularly suited for use as a Frost Wall.

Conclusion

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property is claimed as follows:

1. A preformed wall panel having base and top ends and two vertical side edges for installation on a supporting surface, comprising:

a) a wall portion having a width, height and thickness to provide structural rigidity and fitted on one side, a flange side, with a vertical flange form having an interior flange volume for forming a flange on the wall portion when filled with binder material wherein the improvement comprises:

b) a footing form for providing a footing volume to be filled with binder material, the footing form having an upper wall-mounted edge portion extending along the side of the wall portion, the footing form being positioned above and near adjacent to the base end of the wall panel and extending across the width of the wall panel to the respective vertical side edges of the wall panel, the footing form further:

i) extending laterally away from the wall portion on the flange side of the wall portion and having the upper wall-mounted edge portion embedded in or otherwise permanently attached to the wall portion so as to cause the footing form to remain permanently with the wall portion once the footing volume has been filled with binder material to thereby serve as reinforcing for the binder, and being:

ii) positioned beneath, connected to and extending laterally from the flange form to provide the footing volume whereby the footing form can be filled with binder material that serves as a footing along the base end of the panel, iii) downwardly open but upwardly closed for covering and confining such binder material between the footing form, the flange side of the wall portion and the supporting surface when the wall panel is installed on such supporting surface, and iv) open at the ends of the footing form that are adjacent to the respective vertical side edges of the wall panel, and wherein the flange and footing volumes are interconnected to provide continuous, enclosed volumes that serve to contain binder material poured into the footing form through the vertical flange form, and wherein, when two such preformed wall panels are positioned next to each other along their vertical side edges, the adjacent openings at the ends of the enclosing footing form will permit a continuous, interconnected, covered, footing volume to extend between two adjacent wall panels.

2. A wall panel as in claim 1 comprising a plurality of flange forms each connected to the footing volume to provide continuous, interconnected flange and footing volumes that serve to contain binder material poured into the footing form through the vertical flange forms, the wall panel having a ledge protruding along the base end of the wall panel on the side opposite to the flange side.

3. A wall panel as in claim 2 comprising a trough form mounted along the top end of the wall portion defining a trough volume that communicates with said flange volume for receiving binder material at the same time that the flange and footing forms are being filled with binder material.

4. A wall panel as in claim 3 comprising reinforcing couplings seated in and protruding from said wall portion into the trough form to position and support reinforcing rod to be placed within said one or more volumes in combination with the reinforcing rod positioned within one or more of said one or more flange volumes and supported by the reinforcing coupling means, said couplings being in the form of wire which, when not connected to reinforcing rod, are positioned to be bent up to serve as lifting loops.

5. A wall panel as in claim 1 wherein said footing form has an outer edge remote from said wall portion which outer edge is positioned beneath the base of the wall portion when the wall pardon is suspended in a vertical plane, said footing form being made of a resilient material that will allow the outer edge to become aligned with variations in the supporting surface when the preformed wall panel is placed on such surface.

6. A wall panel as in claim 5 wherein the footing form has an outer terminal edge which is formed by bending the footing form inwardly from said outer edge, to extend towards the wall portion and into the footing volume to be cast into the binder material of a footing when the footing form is filled with binder material.

7. A wall panel as in claim 1 wherein the footing form has an outer terminal edge which is formed by bending the footing form inwardly from said outer edge, to extend towards the wall portion and into the footing volume to be cast into the binder material of a footing when the footing form is filled with binder material whereby the footing form will be engaged to such binder material for further reinforcement.

8. A wall panel as in claim 1 wherein the material of the flange and footing forms is of sheet material which is fasten by embedment into the panel wall portion, and wherein the upper wall-mounted edge portion is interrupted from alignment in a straight line so as to reduce the tendency for cracks to proliferate in the wall portion.

9. A wall panel as in claim 1 comprising a beam support post form fitted to said wall portion, said beam support post form being notched at its upper end, below the top end of the wall panel, to receive the end of a beam, and providing an upwardly extending open volume adjacent said wall panel for receiving binder material.

10. A building wall comprising a plurality of panels as in claim 1 mounted on the supporting surface to form the building wall with adjacent vertical side edges of the respective wall panels abutting each other, wherein the footing forms of the respective panels are aligned and connected to each other to provide against said supporting surface a series of continuous, interconnected, covered footing volumes extending along the plurality of wall panels whereby the footing forms can be filled with a continuous volume of binder material that serves as the footing for the building wall; and wherein the footing forms, by reason of such forms being attached to said wall portion so as to remain with the wall portion once the footing volume has been filled with binder material, will thereafter continue to cover and reinforce said footing.

11. A building wall as in claim 10 wherein the panels comprise a trough form mounted along the top end of the wall portion defining a trough volume that communicates with said flange volume for receiving binder material at the same time that the flange and footing forms are being filled with binder material and wherein the wall panels define a closed perimeter building wall and the flange sides of the wall panels are inwardly directed into the interior of the wall perimeter.

12. A building wall as in claim 11 comprising reinforcing couplings seated in and protruding from said wall portions into said footing volumes to position and support reinforcing rod to be placed within said volumes in combination with reinforcing means laid in the interconnected footing volumes bridging between adjacent footing volumes of adjacent wall panels to become embedded therein once the forms are filled with binder material, the reinforcing means being positioned and supported by the reinforcing couplings, and further comprising couplings in the form of wire anchored into the side of the wall panel along the top end of the wall panel to serve as lifting loops.

13. A building wall as in claim 12 having vertical half-flange forms mounted on said wall portions along the two vertical side edges of the wall portions, the outer edge of at least one of said half-flange forms having at least portions of its surface extending to overlap and permit coupling to an adjacent half flange form when two of said wall panels with half flange forms are abutted together, thereby defining a single, common flange form volume.

14. A building wall as in claim 10 comprising two wall panels meeting at an angle and further comprising a corner piece having vertical faces shaped to abut the vertical side edges of adjacent wall panels, said adjacent wall panels having vertical half-forms mounted along said abutting vertical side edges and further comprising a joiner piece for joining said respective half-forms, the corner piece, vertical side edges of adjacent wall panels, vertical half-forms and joiner piece defining a vertical cavity that communicates with the footing volume and trough volume for receiving binder material.

15. A building wall as in claim 14 comprising at least one positioning plate with upwardly bent plate flanges for positioning beneath and aligning said corner piece, said plate flanges embracing portions of the base ends of said respective abutting wall panels.

16. A building wall as in claim 10 wherein said wall panels are serving as the first tier in a multiple-tiered wall, in combination with a second building wall as in claim 10 to form a second tier for said multiple tiered wall, and wherein the wall panels of each tier comprise a trough form mounted along the top end of the wall portion defining a trough volume that communicates with said flange form volumes for receiving binder material at the same time that the flange and footing forms are being filled with binder material, said second building wall being positioned above said first building wall with the footing forms of wall panels of the second tier positioned adjacent and above the trough forms of the wall panels of the first tier of wall panels.

17. A wall panel as in claim 10 wherein the wall portion is made of concrete.

18. A wall panel as in claim 17 further comprising concrete as the binder material present in the trough form and flange and footing form volumes.

19. A wall panel as in claim 1 wherein the wall portion is made of concrete.

20. A wall panel as in claim 19 further comprising concrete as the binder material present in the flange and footing form volumes.

* * * * *